United States Patent [19]

Kale

[11] Patent Number: 4,632,065

[45] Date of Patent: Dec. 30, 1986

[54] THERMAL BAFFLE FOR WATER HEATERS AND THE LIKE

[76] Inventor: Hemant D. Kale, 5145 N. Kenton, Chicago, Ill. 60630

[21] Appl. No.: 724,348

[22] Filed: Apr. 17, 1985

[51] Int. Cl.[4] ..... F22B 5/00

[52] U.S. Cl. ..... 122/13 R; 126/361; 126/362

[58] Field of Search ..... 122/14, 17, 13 R, 13 A, 122/4 A; 126/361, 362; 219/312

[56] References Cited

U.S. PATENT DOCUMENTS

| | | | |
|---|---|---|---|
| 787,909 | 4/1905 | Fox . | |
| 1,016,959 | 2/1912 | Sadtler . | |
| 2,207,057 | 7/1940 | Gulick . | |
| 2,311,469 | 2/1943 | Pruitt . | |
| 2,625,138 | 1/1953 | Jacoby . | |
| 2,814,278 | 11/1957 | Cameron | 122/17 |
| 2,823,649 | 2/1958 | Flynn | 122/17 |
| 2,833,273 | 5/1958 | Miller . | |
| 3,062,233 | 11/1962 | Hammersley . | |
| 3,244,166 | 4/1966 | Miller . | |
| 3,547,306 | 12/1970 | Natterstad . | |
| 3,987,761 | 10/1976 | Downs et al. . | |
| 4,390,008 | 6/1983 | Andrews | 126/362 X |
| 4,413,747 | 11/1983 | Tenold et al. . | |

*Primary Examiner*—Edward G. Favors
*Attorney, Agent, or Firm*—John C. Shepard

[57] ABSTRACT

A hot water heater having a vertical, cylindrical tank with a curved top wall, means for heating water within the tank, a cold water inlet at the bottom and a hot water outlet at the top includes a baffle in the upper portion of the tank for foiling internal thermal convection currents moving along the side and top walls and minimizing the mixing of hot and cold water so that the temperature of the hot water delivered at the outlet remains relatively constant over time.

15 Claims, 14 Drawing Figures

X - Temperature in Deg. F of water drawn

Y - Gallons of hot water removed

THERMAL BAFFLE FOR WATER HEATERS AND THE LIKE

BACKGROUND OF THE INVENTION

1. Technical Field

This invention relates generally to heating appliances such as hot water heaters and, more particularly, to a thermal baffle located within the heater.

2. Background Art

In the prior art, a storage tank water heater replaces hot water withdrawn from the top of the tank with cold water delivered at the bottom of the tank. Because typical tank heating elements cannot heat the water as fast as it is withdrawn, cold water will eventually fill the tank. Even before the tank is filled with cold water, the incoming cold water mixes freely with the heated standing water in the tank thereby causing deterioration of the tank's water temperature. This mixing is partially the result of the currents generated by the inward flow of cold water, by the outward flow of hot water, and by the convection thermal currents established within the tank.

Because of this mixing, hot water delivered by a typical hot water heater will gradually decrease in temperature while water is being withdrawn, only a small amount of high temperature water is delivered relative to the tank's total capacity. The hot water volume delivered to the outlet above a specified temperature can obviously be extended by increasing the size of the tank or by increasing the heat input of the heating elements. The temperature of hot water at the outlet can also be maintained by preventing the mixing of hot and cold water within the tank.

Attempts have been made in the past to contain and control the mixing of hot and cold water by providing separate chambers within the tank for cold and hot water. Miller U.S. Pat. Nos. 2,833,273 and 3,244,166 employ separate chambers within the tank at the inlet. Gulick U.S. Pat. No. 2,207,057 uses a small baffle over the inlet to control mixing. Fox U.S. Pat. No. 787,909 shows the use of a movable barrier.

In substantially different constructions employing the concept of compartmentalization, Jacoby U.S. Pat. No. 2,625,138 divides the tank into a plurality of separate vertical layers by using numerous horizontal baffles and Pruitt U.S. Pat. No. 2,311,469 shows a fuel burner in which several secondary combustion chambers stratify the water in the storage tank.

While these prior art designs tried to reduce flow created by the usual high velocity of incoming cold water and tried to separate hot and cold water layers, none have taken note of the existence of possible convection currents and, thus, none limit the formation of these thermal currents in the tank and preserve the smooth horizontal boundary layer between hot and cold water within the tank. Further, these convection thermal currents are believed to flow primarily along the smooth side surfaces of the tank and are enhanced by the smooth inner surface of the curved top, the "domed" top being common in pressure tanks because of their structural strength. These closed loop currents greatly enhance the mixing of hot and cold water and heretofore no attempt has been made to stop mixing caused by these currents.

SUMMARY OF THE INVENTION

The present invention is directed to overcoming one or more of the problems as set forth above.

According to the present invention, a conventional hot water heater having a vertical tank with a curved top wall includes a baffle in the upper portion of the tank for foiling internal thermal convection currents along the side and top walls while maintaining the existence of a smooth boundary layer between the hot and cold water within the tank.

In one exemplary embodiment of the invention, the baffle includes a flat plate mounted horizontally within the tank near the top of the tank cylindrical side wall adjacent the top wall to prevent currents from moving freely along the side and top walls, the flat plate having one or more apertures therethrough permitting water to flow from the tank through the outlet located at the top of the tank.

A feature of the invention is that the heater will deliver more hot water, in gallons, at a relatively steady temperature.

A further feature of the invention is the minimization of the mixing of hot and cold water within a water heater by the simpliest and least expensive means possible.

Another feature of the invention is that the temperature of hot water delivered at the outlet is held relatively constant without the use of means for stratifying or compartmentalizing the heater tank.

BRIEF DESCRIPTION OF THE DRAWINGS

The details of construction and operation of the invention are more fully described with reference to the accompanying drawings which form a part hereof and in which like reference numerals refer to like numerals throughout.

In the drawings.

DESCRIPTION OF THE PREFERRED EMBODIMENTS

Best Modes for Carrying Out the Invention

Figure 1:
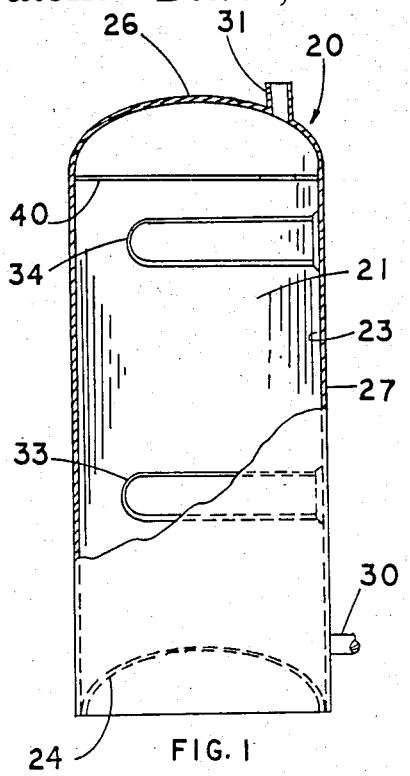
FIG. 1 is a side elevational view, partially in section, of a first embodiment of a hot water heater constructed in accordance with the present invention employing a plate baffle adjacent the top of the heater tank.
Figure 9:
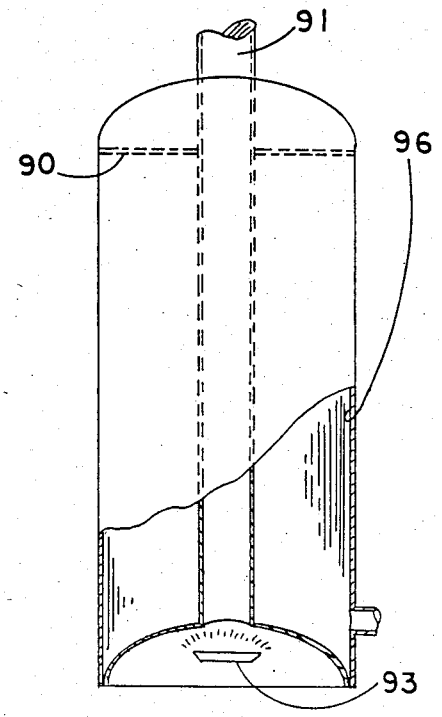
FIG. 9 is a side elevational view, partially in section, of a sixth embodiment of a hot water heater constructed in accordance with the present invention employing a baffle placed around the flue.

Referring to FIG. 1 of the drawings, a conventional, non-compartmentalized hot water heater, generally designated 20, has a storage tank 21 with an upright, vertical cylindrical axis. The tank 21 is defined by a cylindrical side wall 23, a bottom wall 24 and an outwardly concave top wall 26. The storage tank 21 has smooth internal walls and, in the upper portion thereof, its interior is open and free of obstructions. The tank 21 has a cold water inlet 30 generally adjacent the bottom thereof and a hot water outlet 31 generally adjacent the top thereof. As shown herein, two electric heating elements 33 and 34 heat the water within the tank, one heating element 33 being located near the bottom of the tank 21 and the other heating element 34 being located closer to the top of the tank 21. It should be apparent that a single electric coil or a suitably located gas burner as shown in FIG. 9 could also be used to heat the water within the tank.

When the heater 20 is in operation, hot water is withdrawn from the top of the tank 21 by way of the outlet 31. Cold water replacing the water withdrawn enters by way of the inlet 30 at the bottom of the tank 21.

Figure 2:
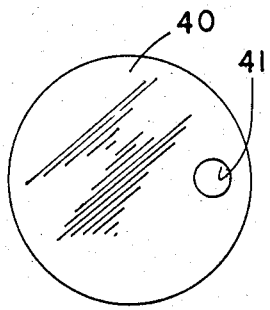
FIG. 2 is a top plan view of the plate baffle shown in FIG. 2 with a single off-center aperture.

In a first embodiment of the invention as shown in FIGS. 1 and 2, a flat, thin, circular baffle 40 is placed in the open, top portion of the tank 21 near the top thereof. The transverse baffle 40, which may be made of metal or other suitable material and is force or friction fit within the tank 21, extends radially inward from the tank wall 23 to obstruct currents along the wall surface. The baffle 40 has an off-center aperture 41 at one side thereof to permit water to flow from the remainder of the tank 21 out through the outlet 31 located thereabove. The baffle 40 obstructs laminar-type flows along the upper surfaces of the tank 21 so that convection thermal currents do not move along the side wall 23 of the tank 21. Because of the obstruction of the currents, the closed loop convection currents that may otherwise be established within the tank 21 are foiled. This minimizes mixing of cold and hot water and the resultant temperature equalization within the tank 21. As shown herein, the baffle 40 is mounted adjacent the intersection of the side wall 23 and the top wall 26 to provide substantially continuous engagement between the baffle 40 and the side wall 23.

Figure 3:
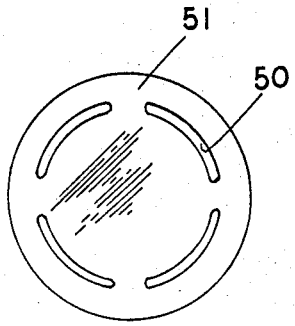
FIG. 3 is a top plan view of a second embodiment with a plate baffle having a plularity of arcuate slots.

In a second embodiment of the invention shown in FIG. 3, a flat, circular baffle 51 high in the tank has four spaced annular apertures 50 to allow flow of water therepast.

Figure 4:
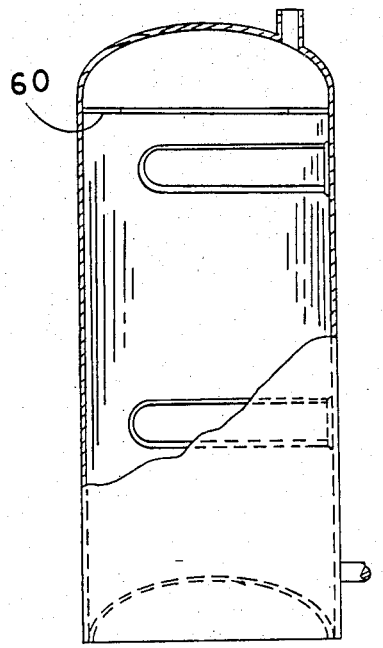
FIG. 4 is a side elevational view, partially in section, of a third embodiment of a hot water heater constructed in accordance with the present invention employing a ring baffle.
Figure 5:
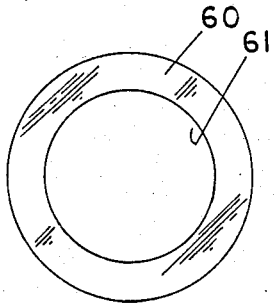
FIG. 5 is a top plan view of the ring baffle shown in FIG. 4 with a single centered aperture.

In a third embodiment of the invention shown in FIGS. 4 and 5, the baffle 60 is a flat annular ring with a single centered aperture 61 to allow flow of water therepast. The baffle 60 has an outer diameter approximately equal to the inner diameter of the tank. The baffle 60 simply prevents the establishment of currents between the top and side along the inner surfaces of the tank.

Figure 6:
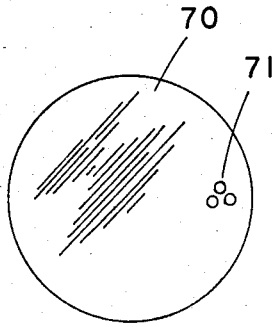
FIG. 6 is a top plan view of a fourth embodiment with a plate baffle having a plurality of apertures.

In a fourth embodiment of the invention shown in FIG. 6, a flat, circular baffle 70 high in the tank has a group of annular bores 71 allowing flow of water therepast and functions similar to the single aperture baffle shown in FIGS. 1 and 2.

Figure 7:
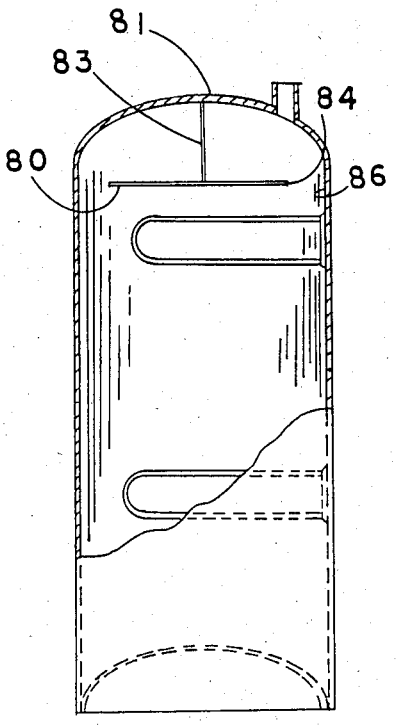
FIG. 7 is a side elevational view, partially in section, of a fifth embodiment of a hot water heater constructed in accordance with the present invention employing a T-shaped plate baffle.
Figure 8:
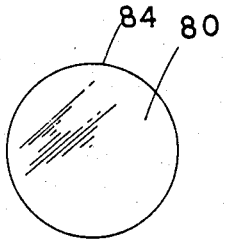
FIG. 8 is a bottom plan view of the T-shaped plate baffle shown in FIG. 7.

In a fifth embodiment of the invention shown in FIGS. 7 and 8, a circular plate baffle 80 is mounted to the top wall 81 by way of a vertical strut 83. The T-shaped baffle 80 has an outer edge 84 spaced from the cylindrical side wall 86.

Figure 10:
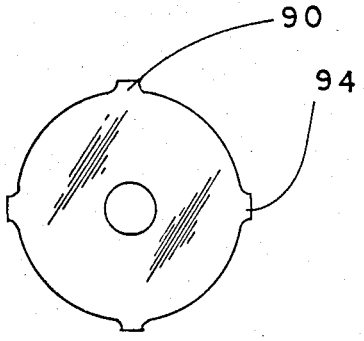
FIG. 10 is a top plan view of the baffle shown in FIG. 9.

In a sixth embodiment of the invention shown in FIGS. 9 and 10, a spider-shaped baffle 90 is disposed around the central flue 91 of a heater using a burner 93. The legs 94 of the spider 90 extending to the tank side wall 96 mount the baffle 90 in spaced relation from the side wall 96.

Comparison tests were conducted using a conventional-type water heater, which was purchased commercially from Sears, Roebuck and Company, and identical heaters employing baffles as described herein. Three baffled heaters were built, each using one of the baffles illustrated in FIGS. 5, 6 and 8. All of the tests employed 14-inch diameter, 30-gallon, electric hot water heaters.

In each of the tests, the heater was flushed for one hour by allowing water to run through the tank without energizing the heating elements. The outlet was then closed, the heating elements energized, and a starting time recorded. The water was heated until the internal thermostat of the heater shut off the heating elements, at which point a second time was recorded. Immediately thereupon, the outlet was opened and outlet water temperature measured at five-second intervals until the outlet temperature dropped to 100 degrees Fahrenheit. The outlet was then closed and total water output was ascertained. The delivery rate in gallons per minute was then calculated from the total water output and the elapsed time. Also, a determination was made of the total kilowatt input to the heater including the kilowatts added to the heater before the withdrawal of water and the kilowatts added during withdrawal of the water.

The tables following the description summarize the results of tests run at various flow rates. For simplicity, a complete test sheet for only one test on the conventional heater and one on the baffled heater is reproduced below. Tables A, B, C and D, however, provide the summary data on each heater.

Table A lists the data obtained from the commercially purchased heater;

Table B lists the data obtained from the heater employing the ring baffle with the 10-inch central aperture shown in FIGS. 4 and 5;

Table C lists the data obtained from the heater employing the flat baffle shown in FIG. 6; and Table D lists the data obtained from the heater employing a 13.5-inch diameter baffle shown in FIGS. 7 and 8.

In the tables, degree-gallons were calculated as follows:

$$\text{Degree-Gallons} = Q \times (T_1 - T_0),$$

where

Q = quantity of water withdrawn $T_1$ = temperature of water withdrawn $T_0$ = temperature of the inlet water

EXAMPLE $$\text{Degree-Gallons} = 1.589 \times 4 \times (149 - 39) = 699.16$$

where 1.589 = the rate of water withdrawn in gallons per minute

4 = the time in minutes during which outlet water temperature remained at 149 degrees F.

(This example corresponds with the first reading under "Degree-Gallon Output Data" in the commercial heater test data reproduced below).

MODEL . . . SEARS 30G
GPM . . . 1.589
NO. OF TURNS OPEN . . .
WATER HEIGHTS, In. . . . 12 & 6¼
WATER INLET TEMP. DEG F. . . . 39
TOTAL GALLONS COLLECTED . . . 27.95
TOTAL EXT. SURFACE AREA (SQ. FT) = 15.52

TEST NO . . . 3
DATE . . . TIME . . .
TOTAL ELAPSED TIME
(MIN.S:SEC.S) . . . 17:35
INPUT AMPS/VOLTS . . . 15.7/243
TOTAL INPUT KW . . . 7.953

INPUT DATA

| | | | | | | | | | | | | |
|---|---|---|---|---|---|---|---|---|---|---|---|---|
| TIME: | 0:5 | 0:10 | 0:15 | 0:20 | 0:25 | 0:30 | 0:35 | 0:40 | 0:45 | 0:50 | 0:55 | 0:60 |
| TEMP: | 149 | 149 | 149 | 149 | 149 | 149 | 149 | 149 | 149 | 149 | 149 | 149 |
| TIME: | 1:5 | 1:10 | 1:15 | 1:20 | 1:25 | 1:30 | 1:35 | 1:40 | 1:45 | 1:50 | 1:55 | 1:60 |
| TEMP: | 149 | 149 | 149 | 149 | 149 | 149 | 149 | 149 | 149 | 149 | 149 | 149 |
| TIME: | 2:5 | 2:10 | 2:15 | 2:20 | 2:25 | 2:30 | 2:35 | 2:40 | 2:45 | 2:50 | 2:55 | 2:60 |
| TEMP: | 149 | 149 | 149 | 149 | 149 | 149 | 149 | 149 | 149 | 149 | 149 | 149 |
| TIME: | 3:5 | 3:10 | 3:15 | 3:20 | 3:25 | 3:30 | 3:35 | 3:40 | 3:45 | 3:50 | 3:55 | 3:60 |
| TEMP: | 149 | 149 | 149 | 149 | 149 | 149 | 149 | 149 | 149 | 149 | 149 | 149 |
| TIME: | 4:5 | 4:10 | 4:15 | 4:20 | 4:25 | 4:30 | 4:35 | 4:40 | 4:45 | 4:50 | 4:55 | 4:60 |
| TEMP: | 148 | 148 | 148 | 148 | 148 | 148 | 148 | 148 | 148 | 148 | 148 | 148 |
| TIME: | 5:5 | 5:10 | 5:15 | 5:20 | 5:25 | 5:30 | 5:35 | 5:40 | 5:45 | 5:50 | 5:55 | 5:60 |
| TEMP: | 148 | 148 | 148 | 148 | 148 | 147 | 147 | 147 | 147 | 147 | 147 | 147 |
| TIME: | 6:5 | 6:10 | 6:15 | 6:20 | 6:25 | 6:30 | 6:35 | 6:40 | 6:45 | 6:50 | 6:55 | 6:60 |
| TEMP: | 147 | 147 | 147 | 147 | 147 | 147 | 147 | 147 | 146 | 146 | 146 | 146 |
| TIME: | 7:5 | 7:10 | 7:15 | 7:20 | 7:25 | 7:30 | 7:35 | 7:40 | 7:45 | 7:50 | 7:55 | 7:60 |
| TEMP: | 146 | 146 | 146 | 146 | 146 | 145 | 145 | 145 | 145 | 145 | 145 | 145 |
| TIME: | 8:5 | 8:10 | 8:15 | 8:20 | 8:25 | 8:30 | 8:35 | 8:40 | 8:45 | 8:50 | 8:55 | 8:60 |
| TEMP: | 145 | 144 | 144 | 144 | 144 | 144 | 144 | 144 | 144 | 143 | 143 | 143 |
| TIME: | 9:5 | 9:10 | 9:15 | 9:20 | 9:25 | 9:30 | 9:35 | 9:40 | 9:45 | 9:50 | 9:55 | 9:60 |
| TEMP: | 143 | 143 | 143 | 143 | 142 | 142 | 142 | 142 | 142 | 142 | 141 | 141 |
| TIME: | 10:5 | 10:10 | 10:15 | 10:20 | 10:25 | 10:30 | 10:35 | 10:40 | 10:45 | 10:50 | 10:55 | 10:60 |
| TEMP: | 141 | 141 | 141 | 141 | 140 | 140 | 140 | 140 | 140 | 140 | 139 | 139 |
| TIME: | 11:5 | 11:10 | 11:15 | 11:20 | 11:25 | 11:30 | 11:35 | 11:40 | 11:45 | 11:50 | 11:55 | 11:60 |
| TEMP: | 139 | 139 | 139 | 138 | 138 | 138 | 138 | 137 | 137 | 137 | 137 | 137 |
| TIME: | 12:5 | 12:10 | 12:15 | 12:20 | 12:25 | 12:30 | 12:35 | 12:40 | 12:45 | 12:50 | 12:55 | 12:60 |
| TEMP: | 136 | 136 | 136 | 136 | 136 | 135 | 135 | 135 | 134 | 134 | 134 | 134 |
| TIME: | 13:5 | 13:10 | 13:15 | 13:20 | 13:25 | 13:30 | 13:35 | 13:40 | 13:45 | 13:50 | 13:55 | 13:60 |
| TEMP: | 133 | 133 | 133 | 133 | 132 | 132 | 132 | 132 | 131 | 131 | 131 | 131 |
| TIME: | 14:5 | 14:10 | 14:15 | 14:20 | 14:25 | 14:30 | 14:35 | 14:40 | 14:45 | 14:50 | 14:55 | 14:60 |
| TEMP: | 130 | 130 | 130 | 129 | 129 | 128 | 128 | 127 | 127 | 126 | 126 | 125 |
| TIME: | 15:5 | 15:10 | 15:15 | 15:20 | 15:25 | 15:30 | 15:35 | 15:40 | 15:45 | 15:50 | 15:55 | 15:60 |
| TEMP: | 125 | 124 | 124 | 124 | 123 | 123 | 123 | 122 | 121 | 120 | 119 | 119 |
| TIME: | 16:5 | 16:10 | 16:15 | 16:20 | 16:25 | 16:30 | 16:35 | 16:40 | 16:45 | 16:50 | 16:55 | 16:60 |
| TEMP: | 118 | 118 | 117 | 116 | 115 | 115 | 114 | 113 | 112 | 111 | 110 | 109 |
| TIME: | 17:5 | 17:10 | 17:15 | 17:20 | 17:25 | 17:30 | 17:35 | 17:40 | 17:45 | 17:50 | 17:55 | 17:60 |
| TEMP: | 108 | 107 | 106 | 105 | 103 | 102 | 100 | | | | | |

DEGREE-GALLONS OUTPUT DATA:

| I | TIME | T(I) | DG(I) | I | TIME | T(I) | DG(I) | I | TIME | T(I) | DG(I) |
|---|---|---|---|---|---|---|---|---|---|---|---|
| 1 | 4:0 | 149 | 699.16 | 2 | 5:25 | 148 | 245.368 | 3 | 6:40 | 147 | 214.515 |
| 4 | 7:25 | 146 | 127.517 | 5 | 8:5 | 145 | 112.289 | 6 | 8:45 | 144 | 111.23 |
| 7 | 9:20 | 143 | 96.3993 | 8 | 9:50 | 142 | 81.8335 | 9 | 10:20 | 141 | 81.039 |
| 10 | 10:50 | 140 | 80.2445 | 11 | 11:15 | 139 | 66.2083 | 12 | 11:35 | 138 | 52.437 |
| 13 | 12:0 | 137 | 64.8842 | 14 | 12:25 | 136 | 64.2221 | 15 | 12:40 | 135 | 38.136 |
| 16 | 13:0 | 134 | 50.3183 | 17 | 13:20 | 133 | 49.7887 | 18 | 13:40 | 132 | 49.259 |
| 19 | 14:0 | 131 | 48.7293 | 20 | 14:15 | 130 | 36.1498 | 21 | 14:25 | 129 | 23.835 |
| 22 | 14:35 | 128 | 23.5702 | 23 | 14:45 | 127 | 23.3053 | 24 | 14:55 | 126 | 23.0405 |
| 25 | 15:5 | 125 | 22.7757 | 26 | 15:20 | 124 | 33.7663 | 27 | 15:35 | 123 | 33.369 |
| 28 | 15:40 | 122 | 10.9906 | 29 | 15:45 | 121 | 10.8582 | 30 | 15:50 | 120 | 10.7258 |
| 31 | 16:0 | 119 | 21.1867 | 32 | 16:10 | 118 | 20.9218 | 33 | 16:15 | 117 | 10.3285 |
| 34 | 16:20 | 116 | 10.1961 | 35 | 16:30 | 115 | 20.1273 | 36 | 16:35 | 114 | 9.93125 |
| 37 | 16:40 | 113 | 9.79883 | 38 | 16:45 | 112 | 9.66642 | 39 | 16:50 | 111 | 9.534 |
| 40 | 16:55 | 110 | 9.40158 | 41 | 17:0 | 109 | 9.26917 | 42 | 17:5 | 108 | 9.13675 |
| 43 | 17:10 | 107 | 9.00433 | 44 | 17:15 | 106 | 8.87192 | 45 | 17:20 | 105 | 8.7395 |
| 46 | 17:25 | 103 | 8.47467 | 47 | 17:30 | 102 | 8.34225 | 48 | 17:35 | 100 | 8.07742 |

MODEL . . . SEARS 30G GPM . . . 1.589
TOTAL TIME IN SEC. S = 1055
TOTAL OUTPUT IN DEGREE/GALLONS (100 DEG DATUM) = 2786.97
TOTAL OUTPUT IN DEGREE-GALLONS/KW = 350.431
TOTAL OUTPUT IN DEGREE-GALLONS/KW/SQ. FT = 22.5793

-continued

PERCENTAGE OF CAPACITY DELIVERED = .931667

MODEL . . . BAFFLED
GPM . . . 1.546
NO. OF TURNS OPEN . . .
WATER HEIGHTS, In. . . . 12 & 6½
WATER INLET TEMP. DEG F. . . . 37
TOTAL GALLONS COLLECTED . . . 28.35
TOTAL EXT. SURFACE AREA (SQ. FT) = 15.52

TEST NO . . . 3
DATE . . . TIME . . .
TOTAL ELAPSED TIME
(MIN.S:SEC.S) . . . 18:30
INPUT AMPS/VOLTS . . . 16/245
TOTAL INPUT KW . . . 7.922

INPUT DATA

| | | | | | | | | | | | | |
|---|---|---|---|---|---|---|---|---|---|---|---|---|
| TIME: | 0:5 | 0:10 | 0:15 | 0:20 | 0:25 | 0:30 | 0:35 | 0:40 | 0:45 | 0:50 | 0:55 | 0:60 |
| TEMP: | 148 | 148 | 148 | 148 | 148 | 148 | 148 | 148 | 148 | 147 | 147 | 147 |
| TIME: | 1:5 | 1:10 | 1:15 | 1:20 | 1:25 | 1:30 | 1:35 | 1:40 | 1:45 | 1:50 | 1:55 | 1:60 |
| TEMP: | 147 | 147 | 147 | 147 | 147 | 146 | 146 | 146 | 146 | 146 | 146 | 146 |
| TIME: | 2:5 | 2:10 | 2:15 | 2:20 | 2:25 | 2:30 | 2:35 | 2:40 | 2:45 | 2:50 | 2:55 | 2:60 |
| TEMP: | 146 | 146 | 146 | 146 | 146 | 146 | 146 | 146 | 146 | 146 | 146 | 146 |
| TIME: | 3:5 | 3:10 | 3:15 | 3:20 | 3:25 | 3:30 | 3:35 | 3:40 | 3:45 | 3:50 | 3:55 | 3:60 |
| TEMP: | 146 | 146 | 146 | 146 | 146 | 146 | 146 | 146 | 146 | 146 | 146 | 146 |
| TIME: | 4:5 | 4:10 | 4:15 | 4:20 | 4:25 | 4:30 | 4:35 | 4:40 | 4:45 | 4:50 | 4:55 | 4:60 |
| TEMP: | 146 | 146 | 146 | 146 | 146 | 146 | 146 | 146 | 146 | 146 | 146 | 146 |
| TIME: | 5:5 | 5:10 | 5:15 | 5:20 | 5:25 | 5:30 | 5:35 | 5:40 | 5:45 | 5:50 | 5:55 | 5:60 |
| TEMP: | 146 | 146 | 146 | 146 | 146 | 146 | 146 | 146 | 146 | 146 | 146 | 146 |
| TIME: | 6:5 | 6:10 | 6:15 | 6:20 | 6:25 | 6:30 | 6:35 | 6:40 | 6:45 | 6:50 | 6:55 | 6:60 |
| TEMP: | 146 | 146 | 146 | 146 | 146 | 146 | 146 | 146 | 146 | 146 | 146 | 146 |
| TIME: | 7:5 | 7:10 | 7:15 | 7:20 | 7:25 | 7:30 | 7:35 | 7:40 | 7:45 | 7:50 | 7:55 | 7:60 |
| TEMP: | 146 | 146 | 146 | 146 | 146 | 146 | 146 | 146 | 146 | 146 | 146 | 146 |
| TIME: | 8:5 | 8:10 | 8:15 | 8:20 | 8:25 | 8:30 | 8:35 | 8:40 | 8:45 | 8:50 | 8:55 | 8:60 |
| TEMP: | 145 | 145 | 145 | 145 | 145 | 145 | 145 | 145 | 145 | 145 | 145 | 145 |
| TIME: | 9:5 | 9:10 | 9:15 | 9:20 | 9:25 | 9:30 | 9:35 | 9:40 | 9:45 | 9:50 | 9:55 | 9:60 |
| TEMP: | 145 | 145 | 145 | 145 | 145 | 145 | 145 | 145 | 145 | 145 | 145 | 145 |
| TIME: | 10:5 | 10:10 | 10:15 | 10:20 | 10:25 | 10:30 | 10:35 | 10:40 | 10:45 | 10:50 | 10:55 | 10:60 |
| TEMP: | 145 | 145 | 145 | 145 | 145 | 145 | 145 | 145 | 145 | 145 | 145 | 145 |
| TIME: | 11:5 | 11:10 | 11:15 | 11:20 | 11:25 | 11:30 | 11:35 | 11:40 | 11:45 | 11:50 | 11:55 | 11:60 |
| TEMP: | 145 | 145 | 145 | 145 | 145 | 145 | 145 | 145 | 145 | 145 | 145 | 145 |
| TIME: | 12:5 | 12:10 | 12:15 | 12:20 | 12:25 | 12:30 | 12:35 | 12:40 | 12:45 | 12:50 | 12:55 | 12:60 |
| TEMP: | 145 | 145 | 145 | 145 | 145 | 145 | 145 | 145 | 145 | 145 | 145 | 145 |
| TIME: | 13:5 | 13:10 | 13:15 | 13:20 | 13:25 | 13:30 | 13:35 | 13:40 | 13:45 | 13:50 | 13:55 | 13:60 |
| TEMP: | 145 | 145 | 145 | 145 | 145 | 145 | 145 | 145 | 145 | 145 | 145 | 145 |
| TIME: | 14:5 | 14:10 | 14:15 | 14:20 | 14:25 | 14:30 | 14:35 | 14:40 | 14:45 | 14:50 | 14:55 | 14:60 |
| TEMP: | 145 | 145 | 145 | 145 | 145 | 145 | 145 | 145 | 145 | 145 | 145 | 145 |
| TIME: | 15:5 | 15:10 | 15:15 | 15:20 | 15:25 | 15:30 | 15:35 | 15:40 | 15:45 | 15:50 | 15:55 | 15:60 |
| TEMP: | 145 | 145 | 145 | 145 | 145 | 145 | 145 | 145 | 145 | 145 | 145 | 145 |
| TIME: | 16:5 | 16:10 | 16:15 | 16:20 | 16:25 | 16:30 | 16:35 | 16:40 | 16:45 | 16:50 | 16:55 | 16:60 |
| TEMP: | 144 | 144 | 144 | 144 | 144 | 144 | 144 | 143 | 142 | 141 | 140 | 139 |
| TIME: | 17:5 | 17:10 | 17:15 | 17:20 | 17:25 | 17:30 | 17:35 | 17:40 | 17:45 | 17:50 | 17:55 | 17:60 |
| TEMP: | 137 | 135 | 133 | 130 | 126 | 123 | 120 | 117 | 113 | 111 | 108 | 106 |
| TIME: | 18:5 | 18:10 | 18:15 | 18:20 | 18:25 | 18:30 | 18:35 | 18:40 | 18:45 | 18:50 | 18:55 | 18:60 |
| TEMP: | 105 | 103 | 101 | 100 | 100 | 100 | 0 | 0 | 0 | 0 | 0 | 0 |

DEGREE-GALLONS OUTPUT DATA:

| I | TIME | T(I) | DG(I) | I | TIME | T(I) | DG(I) | I | TIME | T(I) | DG(I) |
|---|---|---|---|---|---|---|---|---|---|---|---|
| 1 | 0:45 | 148 | 128.705 | 10 | 17:0 | 139 | 13.141 | 19 | 17:45 | 113 | 9.79134 |
| 2 | 1:25 | 147 | 113.373 | 11 | 17:5 | 137 | 12.8833 | 20 | 17:50 | 111 | 9.53367 |
| 3 | 8:0 | 146 | 1109.38 | 12 | 17:10 | 135 | 12.6257 | 21 | 17:55 | 108 | 9.14717 |
| 4 | 16:0 | 145 | 1335.74 | 13 | 17:15 | 133 | 12.368 | 22 | 18:0 | 106 | 8.8895 |
| 5 | 16:35 | 144 | 96.4962 | 14 | 17:20 | 130 | 11.9815 | 23 | 18:5 | 105 | 8.76067 |
| 6 | 16:40 | 143 | 13.6563 | 15 | 17:25 | 126 | 11.4662 | 24 | 18:10 | 103 | 8.503 |
| 7 | 16:45 | 142 | 13.5275 | 16 | 17:30 | 123 | 11.0797 | 25 | 18:15 | 101 | 8.24534 |
| 8 | 16:50 | 141 | 13.3987 | 17 | 17:35 | 120 | 10.6932 | 26 | 18:30 | 100 | 24.3495 |
| 9 | 16:55 | 140 | 13.2698 | 18 | 17:40 | 117 | 10.3067 | 27 | 999:0 | 0 | 0 |

MODEL . . . BAFFLED GPM . . . 1.546
TOTAL TIME IN SEC.S = 1110
TOTAL OUTPUT IN DEGREE/GALLONS (100 DEG DATUM) = 3031.32
TOTAL OUTPUT IN DEGREE-GALLONS/KW = 382.646
TOTAL OUTPUT IN DEGREE-GALLONS/KW/SQ. FT = 24.655
PERCENTAGE OF CAPACITY DELIVERED = .945

TABLE A

MODEL: SEARS 30G, RATED 3.8 KW, 240 V, 1 PH

| TEST NO. | S1 | S2 | S3 | S4 | S5 |
|---|---|---|---|---|---|
| INLET WATER TEMP. DEG. F. | 35 | 38 | 39 | 38 | 37 |
| GPM (1) | 1.142 | 1.20 | 1.589 | 1.985 | 2.87 |
| TOTAL KW (2) | 8.238 | 7.862 | 7.953 | 7.789 | 7.714 |
| DG-GLN (3) | 2739 | 2637 | 2787 | 2816 | 2777 |
| DG-GLN/KW (4) | 333 | 335 | 350 | 362 | 360 |
| DG-GLN/KW/SQ. FT. (5) | 21.43. | 21.61 | 22.57 | 23.29 | 23.19 |

TABLE A-continued

MODEL: SEARS 30G, RATED 3.8 KW, 240 V, 1 PH

| TEST NO. | S1 | S2 | S3 | S4 | S5 |
|---|---|---|---|---|---|
| GALLONS COLLECTED (6) | 26.96 | 26.76 | 27.95 | 27.95 | 27.55 |
| % OF | 0.90 | 0.89 | 0.93 | 0.93 | 0.92 |

TABLE A-continued

| MODEL: SEARS 30G, RATED 3.8 KW, 240 V, 1 PH | | | | | |
|---|---|---|---|---|---|
| TEST NO. | S1 | S2 | S3 | S4 | S5 |
| CAPACITY (7) | | | | | |

(1) GPM - Gallons per minute
(2) Total Kw - Total KW Input to the heater
(3) DG-GLN - Degree-Gallons of water collected, 100 Deg. F. Datum
(4) DG-GLN/KW - Degree-Gallons per KW of input
(5) DG-GLN/KW/SQ. FT - Degree-Gallons per KW per SQ. Ft. of external surface of tank
(6) GALLONS COLLECTED - Total gallons collected, 100 Deg. F. datum
(7) % Of Capacity - Gallons of hot water (100 Dg. F. datum) delivered as a % of gallon capacity of the tank

TABLE B

| MODEL: HEATER WITH BAFFLE OF FIG. 4–5, 3.80 KW, 240 V, 1 PH | | | |
|---|---|---|---|
| TEST NO. | R1 | R2 | R3 |
| INLET WATER TEMP. DEG. F. | 37 | 38 | 39 |
| GPM | 1.486 | 1.729 | 2.2 |
| TOTAL KW (2) | 7.5012 | 7.4214 | 6.97 |
| DG-GLN (3) | 2732 | 2809 | 2605 |
| DG-GLN/KW (4) | 364 | 379 | 374 |
| DG-GLN/KW/SQ. FT (5) | 23.47 | 24.39 | 24.07 |
| GALLONS COLLECTED (6) | 27.10 | 27.95 | 26.05 |
| % OF CAPACITY (7) | 0.90 | 0.93 | 0.87 |

(1) GPM - Gallons per minute
(2) Total Kw - Total KW Input to the heater
(3) DG-GLN - Degree-Gallons of water collected, 100 Deg. F. Datum
(4) DG-GLN/KW - Degree-Gallons per KW of input
(5) DG-GLN/KW/SQ. FT - Degree-Gallons per KW per SQ. Ft. of external surface of tank
(6) GALLONS COLLECTED - Total gallons collected, 100 Deg. F. datum
(7) % Of Capacity - Gallons of hot water (100 Dg. F. datum) delivered as a % of gallon capacity of the tank

TABLE C

| MODEL: HEATER WITH BAFFLE OF FIG. 6, 3.80 KW, 240 V, 1 PH | | | | | |
|---|---|---|---|---|---|
| TEST NO. | F1 | F2 | F3 | F4 | F5 |
| INLET WATER TEMP. DEG. F. | 37 | 39 | 37 | 39 | 39 |
| GPM (1) | 1.066 | 1.375 | 1.546 | 1.85 | 2.8 |
| TOTAL KW (2) | 8.133 | 8.08 | 7.922 | 8.28 | 7.23 |
| DG-GLN (3) | 3021 | 2970 | 3031 | 3120 | 2815 |
| DG-GLN/KW (4) | 371 | 367 | 383 | 377 | 389 |
| DG-GLN/KW/ SQ. FT. (5) | 23.92 | 23.67 | 24.65 | 24.27 | 25.07 |
| GALLONS COLLECTED (6) | 29.41 | 28.76 | 28.35 | 29.92 | 27.14 |
| % OF CAPACITY (7) | 0.98 | 0.96 | 0.94 | 0.997 | 0.90 |

(1) GPM - Gallons per minute
(2) Total Kw - Total KW input to the heater
(3) DG-GLN - Degree-Gallons of water collected, 100 Deg. F. Datum
(4) DG-GLN/KW - Degree-Gallons per KW of input
(5) DG-GLN/KW/SQ. FT - Degree-Gallons per KW per SQ. Ft. of external surface of tank
(6) GALLONS COLLECTED - Total gallons collected, 100 Deg. F. datum
(7) % Of Capacity - Gallons of hot water (100 Dg. F. datum) delivered as a % of gallon capacity of the tank

TABLE D

| MODEL: HEATER WITH BAFFLE OF FIG. 7–8, 3.8 KW, 240 V, 1 PH | | | |
|---|---|---|---|
| TEST NO. | C1 | C2 | C3 |
| INLET WATER TEMP. DEG. F. | 41 | 42 | 44 |
| GPM (1) | 1.15 | 1.76 | 2.21 |
| TOTAL KW (2) | 8.08 | 7.46 | 8.03 |
| DG-GLN (3) | 2612 | 2506 | 2771 |
| DG-GLN/KW (4) | 323 | 336 | 345 |
| DG-GLN/KW/SQ. FT (5) | 20.82 | 21.64 | 22.22 |
| GALLONS COLLECTED (6) | 26.52 | 25.02 | 25.80 |

TABLE D-continued

| MODEL: HEATER WITH BAFFLE OF FIG. 7–8, 3.8 KW, 240 V, 1 PH | | | |
|---|---|---|---|
| TEST NO. | C1 | C2 | C3 |
| % OF CAPACITY (7) | 0.88 | 0.83 | 0.86 |

Figure 11:
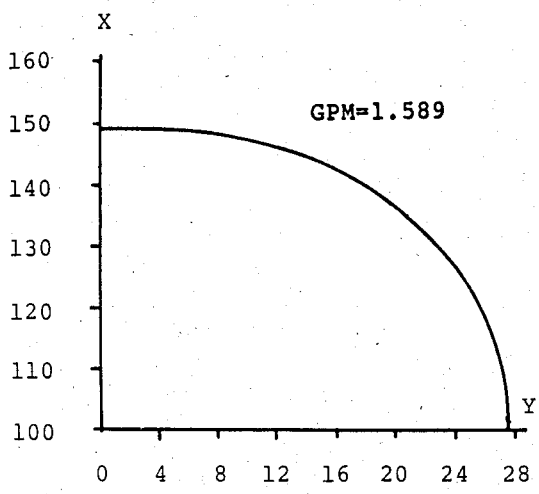
FIG. 11 is a X-Y graph plotting gallons of water delivered versus temperature of water delivered at the outlet in a conventional hot water heater.
Figure 12:
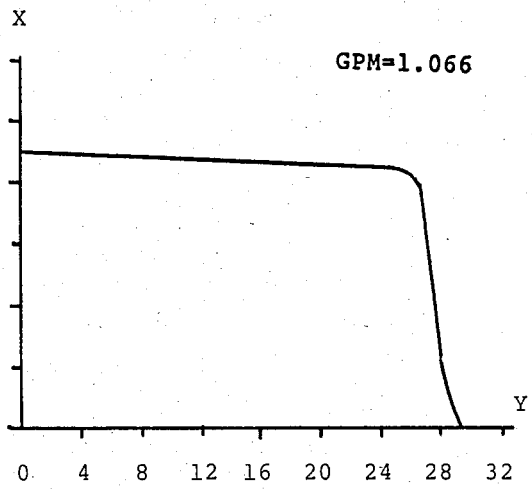
FIG. 12 is a X-Y graph plotting gallons of water delivered versus temperature of water delivered at the outlet in a conventional hot water heater employing the baffle shown in FIG. 6.
Figure 13:
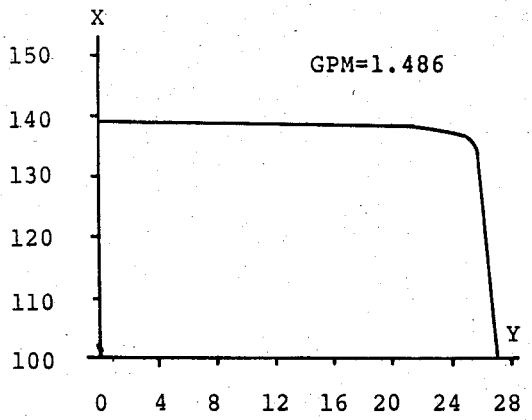
FIG. 13 is a X-Y graph plotting gallons of water delivered versus temperature of water delivered at the outlet in a conventional hot water heater employing the baffle shown in FIGS. 4 and 5; and, FIG. 14 is a X-Y graph plotting gallons of water delivered versus temperature of water delivered at the outlet in a conventional hot water heater employing the baffle shown in FIG. 7 and 8.
Figure 14:
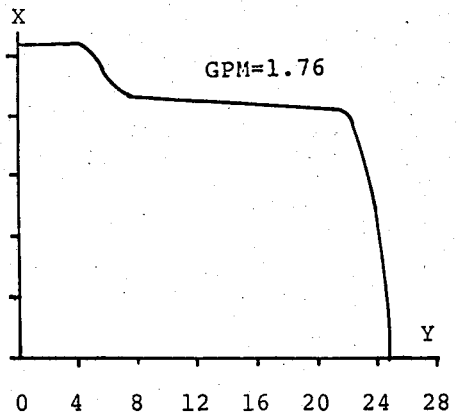

(1) GPM - Gallons per minute
(2) Total Kw - Total KW input to the heater
(3) DG-GLN - Degree-Gallons of water collected, 100 Deg. F. Datum
(4) DG-GLN/KW - Degree-Gallons per KW of input
(5) DG-GLN/KW/SQ. FT - Degree-Gallons per KW per SQ. Ft. of external surface of tank
(6) GALLONS COLLECTED - Total gallons collected, 100 Deg. F. datum
(7) % Of Capacity - Gallons of hot water (100 Dg. F. datum) delivered as a % of gallon capacity of the tank FIG. 11 graphically illustrates the results listed in Table A, and FIGS. 12, 13 and 14 graphically illustrate the dramatic and unexpected results listed in Tables B, C and D, respectively. The downward curve of FIG. 11 indicates that in a conventional heater without a baffle, outlet water temperature declines markedly as water is taken from the tank. In contrast, the flat curves of FIGS. 12 through 14 show that when the tank has a baffle, outlet water temperature remains relatively constant as water is withdrawn until the tank capacity is nearly exhausted. While the total amount of heat in the tank's water is the same in both instances, the baffled tank provides hotter water for a longer period of time.

It should be understood that the shape, size and number of aperture openings can obviously be varied, all the baffles being effective in varying degree in foiling the establishment of thermal currents within the tank without disturbing the smooth boundary layer between hot and cold water and without inducing unneeded turbulence or churning of the water. The anode rod and dip tube (not shown) commonly employed in water heaters may extend through the baffle apertures.

It should also be understood that the baffle can be installed further from the tank top. However, when this is done, convection currents can establish themselves in the portion of the tank above the baffle so that mixing can occur in this portion of the tank. Thus, the effectiveness of the baffle is lessened as the baffle is mounted lower in the tank. It has been found that the difference in performance between the heater with the baffle high up in the tank and the heater with the baffle deep inside the tank is relatively small.

Obviously, the baffle means described herein block or foil the direct flow of thermal convection currents, but do not prevent the flow of water or the gradual migration of heat from the zone around the electric heating elements to the water adjacent the baffle during a heating cycle.

Industrial Applicability

From the foregoing, it should be apparent that the hot water heater described herein is simple and inexpensive, yet provides a convenient and reliable means for delivering more hot water from the tank outlet at a relatively constant temperature for a sustained period of time.

Other aspects, objects and advantages of this invention can be obtained from a study of the drawings, the disclosure and the appended claims.

What is claimed is:

1. In a hot water heater having a vertical storage tank defined by a cylindrical side wall, a bottom wall and a curved top wall and having a non-compartmentalized internal storage area, means for heating water within the tank, a cold water inlet generally adjacent the bottom thereof, and a hot water outlet generally adjacent the the top thereof, the improvement comprising a single, stationary baffle fixed within the tank above the heating means in the upper two-thirds of the tank and transverse to the tank axis, said baffle foiling thermal currents within the tank.

2. The hot water heater of claim 1 wherein said baffle is a plate mounted horizontally within the tank.

3. The hot water heater of claim 2 wherein said plate is mounted adjacent the top of the side wall.

4. The hot water heater of claim 2 wherein said plate has at least one aperture therethrough to allow flow of water between its upper and lower surfaces.

5. The hot water heater of claim 4 wherein said plate has one aperture which is circular and is located at one side thereof.

6. The hot water heater of claim 4 wherein said plate has one aperture which is circular and is located centrally therein.

7. The hot water heater of claim 4 wherein said plate has a plurality of arcuate apertures therethrough to allow flow of water between its upper and lower surfaces.

8. The hot water heater of claim 4 wherein said plate has a plurality of bores therethrough grouped at one side of said plate to allow flow of water between its upper and lower surfaces.

9. The hot water heater of claim 2 wherein said plate is friction fit within the cylindrical side wall of the tank.

10. The hot water heater of claim 2 wherein said plate is suspended in the tank and spaced from the cylindrical side wall.

11. The hot water heater of claim 10 wherein said plate is mounted to the tank by means of a strut attached to the top wall.

12. The hot water heater of claim 2 wherein said baffle is a spider with the legs thereof mounting the baffle in spaced relation to the tank side wall.

13. A water heating and storage appliance comprising a cylindrical storage tank positioned with a vertical cylindrical axis and having a cylindrical side wall, a bottom wall and an outwardly convex top wall defined an internal non-compartmentalized water storage area with smooth walls, means for heating water within said tank, an inlet for delivering water to the bottom portion of said tank, a delivery outlet for withdrawing water from the upper portion of the tank, and a single, thin plate baffle transversely fixed in stationary position above the heating means in the upper portion of the tank for foiling thermal currents along the inner surface of the side and top walls and near the axial center of the tank moving between the bottom and top of the tank, said tank being free of other baffles within the internal storage area, whereby said single baffle provides a deflecting surface to foil smooth flow of thermal currents and maintains the boundary layer between hot and cold water within the tank to minimize the mixing of hot and cold water caused by turbulence or churning.

14. A water heating and storage appliance comprising a cylindrical storage tank positioned with a vertical cylindrical axis and having a cylindrical side wall, a bottom wall and an outwardly convex top wall defining an internal non-compartmentalized water storage area with smooth walls, means for heating water within said tank, an inlet for delivering water to the bottom portion of said tank, a delivery outlet for withdrawing water from the upper portion of the tank, and a single, thin plate baffle fixed in stationary position in the upper portion of the tank for foiling thermal currents along the inner surface of the side and top walls and near the axial center of the tank moving between the bottom and top of the tank, said baffle being mounted horizontally within said tank at a height adjacent the intersection of said side and top walls and said tank being free of other baffles within the internal storage area, whereby said single baffle provides a deflecting surface to foil smooth flow of thermal currents and maintains the boundary layer between hot and cold water within the tank to minimize the mixing of hot and cold water caused by turbulence or churning.

15. In a hot water heater having a vertical storage tank defined by a cylindrical side wall, a bottom wall and a curved top wall with a vertical extending flue and having a non-compartmentalized internal storage area, means for heating water within the tank, a cold water inlet generally adjacent the bottom thereof, and a hot water outlet generally adjacent the the top thereof, the improvement comprising a single, stationary baffle fixed within the tank around the flue above the heating means in the upper two-thirds of the tank and transverse to the tank axis, said baffle foiling thermal currents within the tank.

* * * * *